United States Patent [19]

Martin, Jr.

[11] 4,315,579

[45] Feb. 16, 1982

[54] VENTING AND FILTERING MECHANISM FOR MILK TANK VENT

[76] Inventor: Timothy J. Martin, Jr., 1328 Pangborn Rd., Lynden, Wash. 98264

[21] Appl. No.: 104,091

[22] Filed: Dec. 17, 1979

[51] Int. Cl.[3] ..... B65D 51/16; B65D 51/18

[52] U.S. Cl. ..... 220/371; 55/385C; 98/6; 98/8; 137/588; 220/254; 220/374; 280/5 D; 280/50 SE

[58] Field of Search ..... 55/385 F, 385 C, 385 R; 98/6, 8, 13, 19; 296/217, 218, 219, 221, 15; 220/371, 372, 373, 374, 254, 256, 259, 334; 137/588

[56] References Cited

U.S. PATENT DOCUMENTS

| | | | |
|---|---|---|---|
| 2,092,925 | 9/1937 | Lithson | 55/385 R X |
| 2,786,091 | 3/1957 | Spellier | 220/374 X |
| 2,825,276 | 3/1958 | Porter | 220/372 X |
| 2,878,743 | 3/1959 | Trunnell | 55/385 F |
| 3,611,905 | 10/1971 | Brinks | 55/385 C |
| 3,694,566 | 9/1972 | Thompson et al. | 220/372 X |
| 4,081,107 | 3/1978 | Martin, Jr. et al. | 220/374 |
| 4,127,216 | 11/1978 | Martin, Jr. et al. | 220/374 |

*Primary Examiner*—Allan N. Shoap

*Attorney, Agent, or Firm*—Hughes, Barnard & Cassidy

[57] ABSTRACT

A venting and filtering system for minimizing pressure differentials between the interior and exterior of a liquid storage tank while precluding ingress of contaminants into such tank. More specifically, a closure assembly for closing the access manhole in a liquid storage tank—e.g., a tank trailer suitable for transporting a comestible liquid product such as milk—including an upstanding tubular wall defining a vertical passage extending through the closure assembly, a sheet of filter material seated on the wall and extending entirely across the passage, and a dome-shaped cover seated on the upstanding wall and projecting rearwardly therefrom so as to define a downwardly facing vent with the vent, dome-shaped cover and passage defining a tortuous path extending entirely through the closure assembly, and wherein the dome-shaped cover is removably or pivotally secured to the closure assembly so as to permit ease of replacement of the sheet of filter material.

19 Claims, 4 Drawing Figures

VENTING AND FILTERING MECHANISM FOR MILK TANK VENT

BACKGROUND OF THE INVENTION

The present invention relates in general to a venting and filtering system for minimizing pressure differentials between the interior and exterior of a liquid storage tank while, at the same time, precluding entry of contaminants into the interior of the tank; and, more particularly, to an improved closure assembly for closing the access manhole in a liquid storage tank such, for example, as the access manhole commonly located in the top of a tank trailer of the type used to transport comestible liquid products such as milk, wherein (i) the manhole cover is provided with an opening extending vertically therethrough, (ii) an upstanding tubular wall surrounds the opening and defines a vertical passage extending through the manhole cover, (iii) a sheet of filter material is removably secured to the closure assembly and extends completely across the vertical passage in face-to-face contact with the upper edge of the tubular wall about the entire perimeter thereof, and (iv) a dome-shaped cover removably secured to the closure assembly is seated on the upstanding wall and projects rearwardly therefrom to define a downwardly facing vent, with the vent, dome-shaped cover and upstanding wall defining a tortuous path extending through the closure assembly for permitting freedom of air movement therethrough so as to minimize pressure differentials between the interior and exterior of the tank while, at the same time, spillage of the liquid contents of the tank is effectively precluded and contaminants are effectively filtered and prevented from entering into the tank; yet, wherein the tank truck operator has ease of access to the filter medium so that such filter medium can be replaced on a routine periodic basis—e.g., daily.

In the dairy industry, milk is commonly transported from dairy farms to a central processing center by means of tank trucks and trailers. The milk-containing tank itself is generally made of stainless steel and is commonly of a double-wall construction with insulation between the inner and outer stainless steel walls, so that the contained milk can be kept at an adequately low temperature while being transported.

Because of the sanitation requirements of the dairy industry and because of Federal regulations, the interior of the milk tank must be thoroughly washed at periodic intervals. Also, it is necessary to provide the tank with an access opening, commonly called a manhole, to permit an inspector to actually enter the interior of the tank. Obviously, while milk is being transported, this access opening must be properly covered both to prevent milk from being spilled out of the opening and, also, to prevent outside contaminants from entering the tank and being mixed with the milk. There is a further requirement that the interior of the tank be vented to outside atmosphere since, with an airtight tank, even small temperature variations in the milk would cause undesirable pressure differentials between the area inside the tank and the surrounding atmosphere.

Moreover, it will be appreciated by those skilled in the art that during the course of a normal operating day, the tank truck operator will make a number of stops at individual dairy farms where milk will pumped from the individual producers' storage tanks into the tank trailer and, at the end of the day, the milk will be pumped out of the trailer at a centrally located milk processing center. During such on-loading and off-loading operations, milk is being pumped into and out of the tank at relatively high rates—e.g., at rates on the order of up to 400 gallons per minute. Because of this fact, it is essential that provision be made for permitting such relatively high pumping rates without encountering significant increases and/or decreases in interior storage tank pressure, thereby precluding damage to both the storage tank and the pumping means. The venting and filtering system incorporated in the closure assembly for the tank trailer is ideally suited for this purpose.

Typical of the arrangements that have heretofore been provided for venting the interior of a milk storage tank or the like are the venting closure assemblies illustrated and described in U.S. Pat. Nos. 4,081,107 and 4,127,216 issued to Light Industrial Design Co., Inc., as the assignee of Timothy J. Martin, Jr. and David C. Waschke. Such patents illustrate, describe and claim a surge-spill preventing system marketed under the trademark "GASKOVENT" by the assignee of the aforesaid Martin et al patents and wherein a vented sealing device is mounted in the tank manhole and permits of air entry into the interior of the device at diametrically opposed peripheral points, and air movement through the device about the periphery thereof, thus defining an effective seal which prevents spillage of the liquid contents of the tank as a result of the tortuous path through the seal while permitting air movement through such tortuous path for the purpose of tending to equalize the internal tank pressure with atmospheric pressure. An opening is formed in the manhole cover and a piece of filter material is mounted in the opening for the purpose of filtering air movement through the closure assembly.

While the aforesaid prior art closure assemblies have been able to perform the closing, venting and filtering functions for a milk tank, there is a continuing need for improvement with regard to such things as simplicity of structure, ease and realiability of operation, capability of being thoroughly cleaned, low cost of initial fabrication, low cost in operation and maintenance, and ease of replacement of the filter medium on a daily basis.

SUMMARY OF THE INVENTION

It is a general aim of the present invention to provide a simple, effective, and reliable venting and filtering system suitable for use with storage tanks and especially suitable for use with mobile tank trailers of the type used for transporting milk, wherein the venting and filtering system itself defines a tortuous path through the closure assembly, yet which provides means for securely holding the filtering medium in position over the full range of pumping rates commonly employed and wherein such filtering medium can be easily replaced by a tank truck operator.

In another of its important aspects, it is an object of the invention to provide an improved venting and filtering system suitable for use with milk tank trailers and the like which permits of ease of assembly and disassembly for cleaning and maintenance purposes, yet which is highly reliable in operation.

DESCRIPTION OF THE DRAWINGS

These and other objects and advantages of the present invention will become more readily apparent upon reading the following detailed description and upon reference to the attached drawings, in which.

Figure 1:
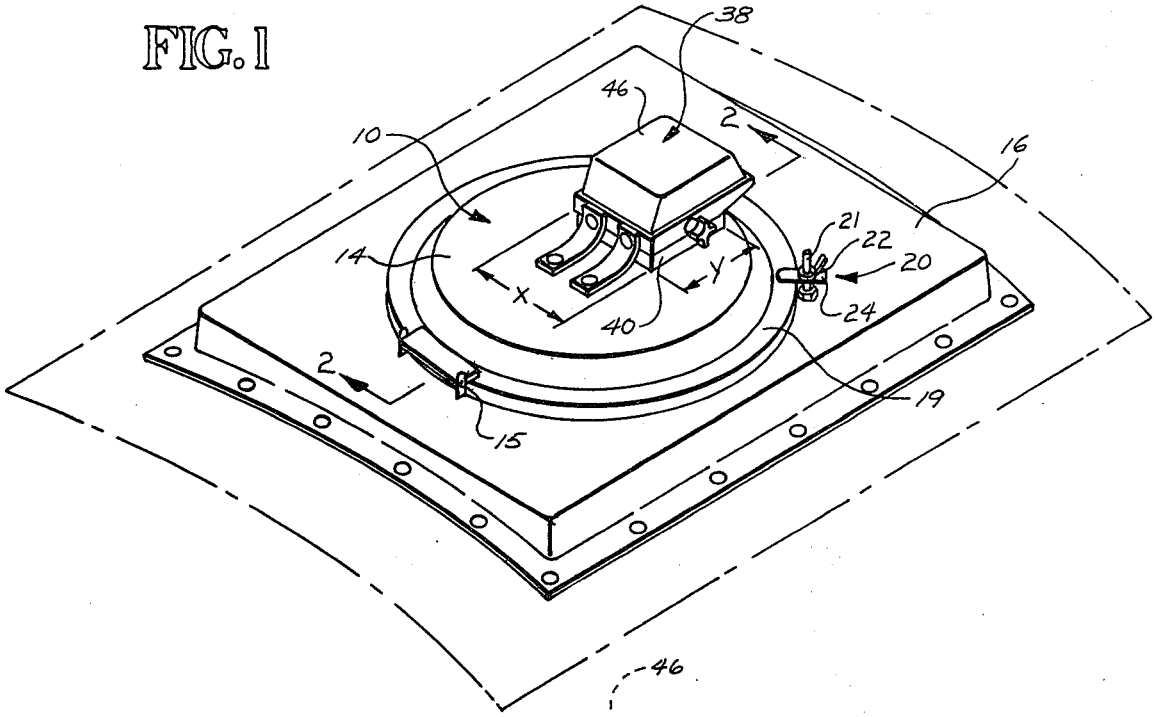
FIG. 1 is a perspective view of a portion of a typical milk tank having a closure assembly thereon incorporating a venting and filtering system embodying the features of the present invention.

While the invention is susceptible of various modifications and alternative forms, a specific embodiment thereof has been shown by way of example in the drawings and will herein be described in detail. It should be understood, however, that it is not intended to limit the invention to the particular form disclosed but, on the contrary, the intention is to cover all modifications, equivalents and alternatives falling within the spirit and scope of the invention as expressed in the appended claims.

DETAILED DESCRIPTION

Figure 2:
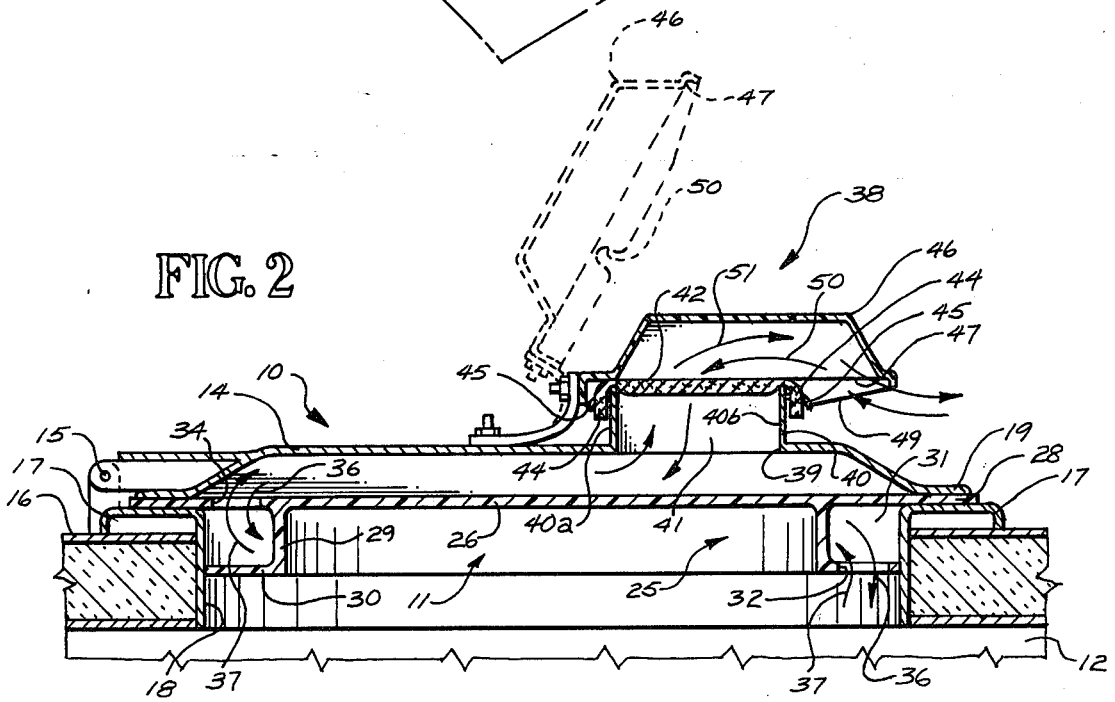
FIG. 2 is a sectional view taken substantially along the line 2—2 in FIG. 1, here illustrating details of the present invention.

Briefly, and referring first to FIGS. 1 and 2 conjointly, there has been illustrated a closure assembly, generally indicated at 10, for closing the access manhole 11 (FIG. 2) formed in the upper wall 12 of a storage tank which, typically, comprises the top of a mobile tank trailer (not shown). As here shown the closure assembly 10 comprises a manhole cover 14 which is pivotally connected or hinged (as indicated at 15) to a relatively flat deckplate 16 having a centrally positioned support ring 17 with an inwardly directed cylindrical wall portion 18 which here defines the access manhole 11. As is conventional with manhole-type closure assemblies of the type here illustrated, the manhole cover 14 is provided with a generally flat peripheral flange 19 adapted to seat on the support ring 17 when the manhole is in the closed position. To retain the cover 14 in the closed position, a plurality of circumferentially spaced retaining members 20, which may be of any conventional design, are positioned about the periphery of the support ring 17. As here shown, each retaining member 20 comprises an upstanding bolt 21 affixed to the support ring 17 and having a nut member 22 threadably mounted thereon which can be screwed down to press a retaining finger 24 downwardly against the peripheral flange 19 to thereby securely clamp the manhole cover 14 to the support ring 17. When the operator desires to open the manhole cover 14 to gain access to the interior of the tank 12, it is merely necessary to loosen the nut members 22, pivot the retaining fingers 24 so that they do not overly flange 19, and then pivot the manhole cover 14 upwardly about its hinged connection 15 to expose the manhole 11 formed in the top of the tank 12.

As described in greater detail in the aforesaid Martin et al U.S. Pat. Nos. 4,081,107 and 4,127,216, a surge-spill preventing device, generally indicated at 25 in FIG. 2 and of the type marketed under the trademark "GASKOVENT" by the assignee of the aforesaid Martin et al patents, is preferably mounted within the access manhole 11. Such surge-spill preventative device 25 is commonly referred to as a "venting closure member" and is preferably molded as a unitary, integral closure element from a moderately compressible or yieldable material such, for example, as silicon rubber. The illustrative venting closure member 25 includes a generally flat, circular main plate or closure portion 26 adapted to extend entirely across the access manhole opening 11 and having a peripheral flange 28 adapted to seat on support ring 17.

To permit freedom for air movement through the venting closure member 25 while preventing spillage of the contents of the tank 12 under surge conditions, the exemplary member 25 includes an annular depending or axially extending web portion 29 terminating in a radially outwardly extending circular flange 30 which snugly and yieldably engages the axially directed cylindrical portion 18 of support ring 17 in liquid-tight sealing relationship therewith. The arrangement is such that the flanges 28, 30 and the web 29 of venting closure member 25, together with the axially directed cylindrical portion 18 of support ring 17, define and enclosed annular or doughnut-shaped passage 31. One or more venting apertures 32 are formed in the inner radial flange 30 adjacent one side of the venting closure member 25, and one or more venting apertures 34 are formed in the outer radial flange 28 at a point diametrically opposite to the venting apertures 32. As a consequence, the venting closure member 25 defines a pair of tortuous paths extending peripherally about the closure member 25 along the doughnut-shaped passage 31 and extending from venting apertures 32 to diametrically opposed venting apertures 34; thereby permitting incoming air, moving as indicated by the arrows 36, to compensate for decreases in internal tank pressure (resulting from either contraction of the liquid contents, out-pumping of the liquid contents, or expansion of the storage tank) and also permitting outflow air movement, as indicated by the arrows 38, to compensate for increasing internal tank pressure (resulting from either expansion of the liquid contents, in-pumping of additional liquid, or contraction of the storage tank). However, in either case—viz., inflow or outflow of air movement—the tortuous air paths defined by venting closure member 25 effectively preclude spillage of the liquid contents of the tank 12 under surge conditions.

In accordance with one of the important aspects of the present invention, provision is made for venting and filtering the air moving inwardly and outwardly through the access manhole 11, preferably through a tortuous flow path in the manhole cover assembly which serves to preclude introduction of rain water, other liquid contaminants and, in addition, solid or particulate airborne foreign contaminating materials. To accomplish this, a venting and filtering system, generally indicated at 38 in FIGS. 1 and 2, is provided having a relatively large opening 39 formed in the upper surface of the manhole cover 14, such opening preferably being surrounded by a tubular upstanding wall 40; the opening 39 and wall 40 defining a vertical passage 41 extending through the manhole cover 14.

In carrying out this aspect of the invention, the wall 40 is preferably rectangular in configuration having a front wall **40*a*, a back wall 40*b*, and a pair of parallel side walls 40*c*, 40*d* (FIG. 4), and having an external transverse dimension x and a length y (FIG. 1). Preferably, the numerical values of x and y are selected such that the opening 39 and vertical passage 41 are large enough as to permit air movement therethrough at rates sufficient to prevent pressure differentials between the interior and exterior of the tank 12** which are in excess of 0.125 lbs./in.$^2$—e.g., approximately 0.21 inches of mercury—when liquids are being pumped into and/or out of the tank at rates of up to on the order of 400 gallons per minute. It has been found that an opening on the order of 36 in.$^2$ in area—for example, a generally square opening where x and y are each somewhat greater than 6" so as to define an opening on the order of 6"×6"—is adequate for the intended purpose.

To effectively filter air moving through the passage 41, a sheet 42 of filter material is preferably secured to the closure member or manhole cover 14 in any suitable manner and extends entirely across the upper edge of the upstanding wall 40 in face-to-face contact therewith throughout the entire perimeter of the wall. As here shown, the filter material 42, which may take the form of an acrylic bonded polyester media of the type manufactured by Kemwove Corp., Charlotte, N.C., has a width (FIG. 4) at least equal to the outside transverse dimension x of the wall 40, and a length (FIG. 2) greater than the outside longitudinal dimension y of the wall 40, thereby permitting the filter medium to engage the entire perimeter of the upper edge of the wall 40 and, at the same time, providing overhanging edges 44 in the y direction which can be removably secured to retaining hooks 45 or the like mounted on the outer surfaces of the front wall 40*a* and the rear wall 40*b* defined by the upstanding continuous wall 40.

In carrying out the present invention, provision is made for shielding the filter medium 42 from direct exposure to external contaminants such as rain water, airborne contaminants, and the like, and for defining a tortuous path through the venting and filtering system 38 of the present invention. To this end, a dome-shaped cover 46 having an interior peripheral shoulder 47 is pivotally secured to the manhole cover 14, for example, by means of rubber straps 48 or the like. The dome-shaped cover 46 and its internal shoulder 47 are preferably dimensioned so that the outer extremities of the parallel longitudinal portions of the shoulder 47 are transversely spaced by a distance equal to x (FIG. 4), while the internal length of the cover 46 is substantially greater than y. As a consequence of this construction, when the cover 46 is in the closed position (as shown by the solid line position in FIG. 2), the internal shoulder 47 is seated on three of the four sides of the upstanding wall 40—viz., the front wall 40*a* and the two parallel longitudinal side walls 40*c*, 40*d* (FIG. 4)—with the filter medium 42 sandwiched therebetween and securely fastened to the fourth wall—i.e., rear wall 40*b*—by hooks 45.

Because the dome-shaped cover 46 has a length substantially greater than y, it projects well beyond the rear wall 40*b* and defines a downwardly facing vent 49. Thus, the downwardly facing vent 49, dome-shaped cover 46, upstanding wall 40 and opening 39 define a tortuous path permitting ingress and egress of air movement as indicated by the arrows 50, 51, respectively, through the manhole cover 14 where the air is effectively filtered by the filter medium 42; yet, wherein the filter medium is effectively shielded from rain water, airborne contaminants, and the like.

Figure 3:
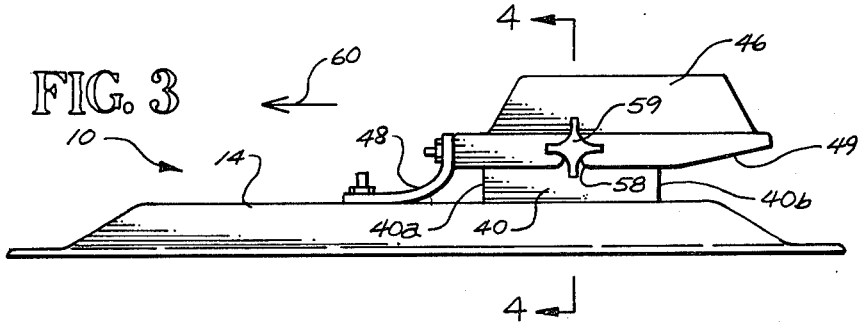
FIG. 3 is a fragmentary side elevational view here illustrating the particular means employed for removably or pivotally securing a dome-shaped cover which forms part of the venting and filtering system to the manhole cover; and, FIG. 4 is a transverse sectional view taken substantially along the line 4—4 in FIG. 3.
Figure 4:
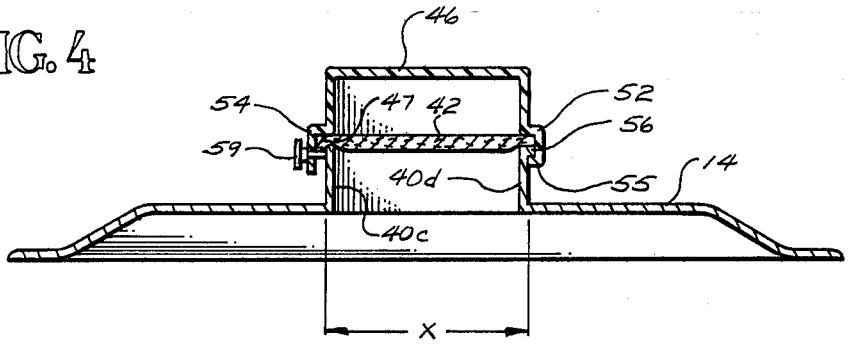

To securely clamp the dome-shaped cover 46 in place, the cover is preferably provided with a pair of downwardly extending longitudinal flanges 52, 54. As best illustrated in FIG. 4, flange 52 is provided with an integral retaining lip 55 positioned to be engaged with a retaining lug 56 integral with the outer surface of wall 40*d*. Flange 54 is provided with a retaining aperture, which here takes the form of a groove 58 (FIGS. 2 and 3), adapted to be interengaged about a suitable threaded fastener 59 threadably engaged with side wall 40*c*. Thus, when the dome-shaped cover 46 is in the closed position as indicated in FIGS. 3 and 4, tightening of the threaded fastener 59 serves to securely lock the cover in place with the filter medium 42 firmly sandwiched and clamped between the shoulder 47 and the upper edges of the three side walls 40*a*, 40*c* and 40*d* defined by the upstanding wall 40. When the tank truck operator desires to replace the filter medium 42—e.g., at the end of the day when the tank has been unloaded at the milk processing center, or at the beginning of the day before starting on his milk pick-up route—it is merely necessary to loosen fastener 59 and pivot the dome-shaped cover 46 to the broken-line position indicated in FIG. 2, thereby completely exposing the filter medium 42 and the hooks 45 on both the front and back walls 40*a* and 40*b*. The old sheet of filter material 42 is unhooked and removed, the new filter medium is hooked in place, the cover 46 is seated on the upper edge of the wall 40, and the fastener 59 is retightened.

A further advantage of the arrangement hereinabove described resides in the fact that the downwardly facing vent 49 is positioned rearwardly of the manhole cover 14—i.e., as the tank trailer is being driven in the direction of arrow 60 (FIG. 3), the vent 49 tends to be shielded from the air moving past and around the wall 40. Consequently, the vent does not function as an air scoop and, therefore, entry of airborne contaminants into the interior of the cover 46 is minimized during motion of the vehicle.

What is claimed is:

1. An improved closure assembly for selectively permitting and precluding access to the interior of an enclosed storage tank through an access opening formed therein while permitting freedom of air movement through the access opening so as to minimize pressure differentials between the interior and exterior of the storage tank while at the same time precluding movement of airborne contaminants therethrough, comprising, in combination: a closure member; means for securing said closure member to the storage tank in overlying relation to the access opening formed therein; means defining a vertical opening extending through said closure member; a tubular upstanding wall integral with said closure member and surrounding the vertical opening formed therein; a sheet of fluid pervious filter material removably secured to said closure member extending entirely across the opening formed therein and in face-to-face engagement with the uppermost edge of said tubular upstanding wall throughout the entire perimeter thereof; a dome-shaped cover seated on said tubular upstanding wall, said dome-shaped cover (a) projecting beyond said tubular upstanding wall on one side thereof so as to form a downwardly facing vent communicating between the interior of said dome-shaped cover and the exterior of the storage tank and (b) contacting said sheet of filter material on the remaining three sides of said upstanding wall for securely clamping said filter material between said upstanding wall and said dome-shaped cover on said three sides; said dome-shaped cover, downwardly facing vent, vertical opening and upstanding wall defining a tortuous flow path; and, means for pivotally securing said dome-shaped cover to said closure member so that air moving between the interior and exterior of the storage tank in response to pressure differentials therebetween is required to pass through both said tortuous path and said sheet of filter material, thereby effectively precluding ingress of contaminants into the interior of the storage tank and minimizing pressure differentials between the interior and exterior thereof.

2. An improved closure assembly as set forth in claim 1 further characterized in that said tortuous flow path is dimensioned to permit introduction and removal of liquids to and from the storage tank at rates at least equal to 400 gallons per minute while precluding pressure differentials between the interior and exterior of the storage tank greater than 0.125 lbs/in.$^2$.

3. An improved closure assembly as set forth in claim 1 further characterized in that said tubular upstanding wall is rectangular in shape having a width x and a length y, said sheet of filter material is rectangular in shape having a width at least equal to x and a length greater than y providing overhanging edges of filter material at the opposite ends of said sheet in the y direction, said overhanging edges of filter material being removably secured to the outer surfaces of said upstanding wall, said dome-shaped cover is rectangular in shape having an internal width x and an internal length greater than y, and rectilinear shoulder defining means formed on the interior of said dome-shaped cover dimensioned to overly and seat upon three of the four sides of said rectangular upstanding wall whereby said sheet of filter material is confined between said shoulder defining means on said dome-shaped cover and said three sides of said rectangular upstanding wall and is removably secured to the outer surface of the fourth side of said wall, and said dome-shaped cover projects beyond said fourth side of said wall and defines said downwardly facing vent.

4. An improved closure assembly as set forth in claim 3 further characterized in that said dome-shaped cover is provided with downwardly extending parallel flanges on two opposed sides thereof outboard of said shoulder defining means, at least one of said flanges having a retaining aperture formed therein, and said means for pivotally securing said dome-shaped cover to said closure member comprises at least one threaded fastening element passing through said retaining aperture and threadably engaged with said rectangular upstanding wall.

5. An improved closure assembly as set forth in claim 4 further characterized in that upon unthreading said fastening element said dome-shaped cover may be pivoted about where it is pivotally secured to said closure member to an open position completely exposing said sheet of filter material so as to permit replacement of said filter material.

6. In a closure assembly for a liquid storage tank of the type having (i) an access opening therein, (ii) a venting closure member mounted in the access opening and defining at least one first tortuous flow path extending therethrough for permitting air movement into and out of the storage tank through the venting closure member in response to pressure differentials between the interior and exterior of the storage tank, and (iii) vented cover means mounted on the storage tak overlying both the access opening therein and said venting closure member:

the improvement in said vented cover means comprising, in combination: means defining a vertical opening extending through said vented cover means; a tubular upstanding wall integral with said vented cover means and surrounding the opening formed therein; a sheet of fluid pervious filter material removably secured to said vented cover means extending entirely across the opening formed therein and in face-to-face engagement with the uppermost edge of said tubular upstanding wall throughout the entire perimeter thereof; a dome-shaped cover seated on said tubular upstanding wall; said dome-shaped cover (a) projecting beyond said continuous upstanding wall on one side thereof so as to form a downwardly facing vent communicating between the interior of said dome-shaped cover and the exterior of the storage tank and (b) contacting said sheet of filter material on the remaining three sides of said upstanding wall for securely clamping said filter material between said upstanding wall and said dome-shaped cover on said three sides; said dome-shaped cover, downwardly facing vent vertical opening and upstanding well defining a second tortuous flow path; and means for pivotally securing said dome-shaped cover to said vented cover means so that air moving between the interior and exterior of the storage tank in response to pressure differentials therebetween is required to pass through both said first and said second tortuous paths and said sheet of filter material, thereby effectively precluding ingress of contaminants into the interior of the storage tank and minimizing pressure differentials between the interior and exterior thereof.

7. An improved vented cover means as set forth in claim 6 further characterized in that said first and second tortuous flow paths are dimensioned to permit introduction and removal of liquids to and from the storage tank at rates at least equal to 400 gallons per minute while precluding pressure differentials between the interior and exterior of the storage tank greater than 0.125 lbs./in.$^2$.

8. An improved vented cover means as set forth in claim 6 further characterized in that said tubular upstanding wall is rectangular in shape having a width x and a length y, said sheet of filter material is rectangular in shape having a width at least equal to x and a length greater than y providing overhanging edges of filter material at the opposite ends of said sheet in the y direction, said overhanging edges of filter material being removably secured to the outer surface of said upstanding wall, said dome-shaped cover is rectangular in shape having an internal width x and an internal length greater than y, and rectilinear shoulder defining means formed on the interior of said dome-shaped cover dimensioned to overly and seat upon three of the four sides of said rectangular upstanding wall whereby said sheet of filter material is confined between said shoulder defining means on said dome-shaped cover and said three sides of said rectangular upstanding wall and is removably secured to the outer surface of the fourth side of said wall, and said dome-shaped cover projects beyond said fourth side of said wall and defines said downwardly facing vent.

9. An improved vented cover means as set forth in claim 8 further characterized in that said dome-shaped cover is provided with downwardly extending parallel flanges on two opposed sides thereof outboard of said shoulder defining means, at least one of said flanges having a retaining aperture formed therein, and said means for pivotally securing said dome-shaped cover to said vented cover means comprises at least one threaded fastening element passing through said retaining aperture and threadably engaged with said rectangular upstanding wall.

10. An improved vented cover means as set forth in claim 9 further characterized in that upon unthreading said fastening element said dome-shaped cover may be pivoted about where it is pivotally secured to said closure member to an open position completely exposing said sheet of filter material so as to permit replacement of said filter material.

11. A tank venting and filtering system comprising, in combination: an enclosed liquid storage tank; means for introducing and removing liquids to and from said tank; an access opening formed in said tank; a closure member; means for securing said closure member to said tank in overlying relation to said access opening; means defining a vertical opening extending through said closure member; a tubular upstanding wall integral with said closure member and surrounding the opening formed therein; a sheet of fluid pervious filter material removably secured to said closure member extending entirely across the opening formed therein in face-to-face engagement with the uppermost edge of said tubular upstanding wall throughout the entire perimeter thereof; a dome-shaped cover seated on said continuous upstanding wall; said dome-shaped cover (a) projecting beyond said continuous upstanding wall on one side thereof so as to form a downwardly facing vent communicating between the interior of said dome-shaped cover and the exterior of said storage tank and (b) contacting said sheet of filter material on the remaining three sides of said upstanding wall for securely clamping said filter material between said upstanding wall and said dome-shaped cover on said three sides; said dome-shaped cover, downwardly facing vent, vertical opening and upstanding wall defining a tortuous flow path; and, means for pivotally securing said dome-shaped cover to said closure member so that air moving between the interior and exterior of said storage tank in response to pressure differentials therebetween is required to pass through both said tortuous path and said sheet of filter material, thereby effectively precluding ingress of contaminants into the interior of said storage tank and minimizing pressure differentials between the interior and exterior thereof.

12. The combination as set forth in claim 11 further characterized in that said liquid storage tank is a mobile tank trailer, said access opening is formed in the top of said tank trailer, and said dome-shaped cover projects beyond said tubular upstanding wall and towards the rear of said tank trailer so that said downwardly facing vent is precluded from functioning as an air scoop during movement of said tank trailer.

13. The combination as set forth in claim 12 further characterized in that said mobile tank trailer is a dairy tanker suitable for transporting comestible dairy products such as milk, said access opening comprises a manhole for permitting cleansing and/or maintenance of the storage tank interior, and said closure member comprises a manhole cover.

14. The combination as set forth in claim 13 further characterized in that said tortuous flow path is dimensioned to permit introduction and removal of milk into and from said storage tank at rates at least equal to 400 gallons per minute while precluding pressure differentials between the interior and exterior of said storage tank greater than 0.125 lbs./in.$^2$.

15. The combination as set forth in claim 13 further characterized in that said tubular upstanding wall is rectangular in shape having a width x and a length y, said sheet of filter material is rectangular in shape having a width at least equal to x and a length greater than y providing overhanging edges of filter material at the opposite ends of said sheet in the y direction, said overhanging edges of filter material being removably secured to the outer surface of said upstanding wall, said dome-shaped cover is rectangular in shape having an internal width x and an internal length greater than y, and rectilinear shoulder defining means formed on the interior of said dome-shaped cover dimensioned to overly and seat upon three of the four sides of said rectangular upstanding wall whereby said sheet of filter material is confined between said shoulder defining means on said dome-shaped cover and said three sides of said rectangular upstanding wall and is removably secured to the outer surface of the fourth side of said wall, and said dome-shaped cover projects rearwardly relative to said storage tank beyond said fourth side of said wall and defines said downwardly facing vent.

16. The combination as set forth in claim 15 further characterized in that said dome-shaped cover is provided with downwardly extending parallel flanges on two opposed sides thereof outboard of said shoulder defining means, at least one of said flanges having a retaining aperture formed therein, and said means for pivotally securing said dome-shaped cover to said manhole cover comprises at least one threaded fastening element passing through said retaining aperture and threadably engaged with said rectangular upstanding wall.

17. The combination as set forth in claim 16 further characterized in that upon unthreading said fastening element said dome-shaped cover may be pivoted about where it is pivotally secured to said closure member to an open position completely exposing said sheet of filter material so as to permit replacement of said filter material.

18. The combination as set forth in claim 13 further characterized in that a venting closure member is mounted in said access opening, said venting closure member including means defining at least one tortuous flow path extending therethrough inwardly of said first mentioned tortuous flow path for precluding spillage of the contents of said storage thank while permitting air movement between the interior and exterior of said storage tank through both of said tortuous flow paths.

19. The combination as set forth in claim 18 further characterized in that both of said tortuous flow paths are dimensioned to permit introduction and removal of milk into and from said storage tank at rates at least equal to 400 gallons per minute while precluding pressure differentials between the interior and exterior of said storage tank greater than 0.125 lbs./in.$^2$.

* * * * *